United States Patent [19]

Ames

[11] 4,169,366

[45] Oct. 2, 1979

[54] DEVICE FOR EXTRUDING HOLLOW AND SEMI-HOLLOW SECTIONS

[75] Inventor: Adolf Ames, Hilizingen, Fed. Rep. of Germany

[73] Assignee: Swiss Aluminium Ltd., Chippis, Switzerland

[21] Appl. No.: 747,551

[22] Filed: Dec. 6, 1976

Related U.S. Application Data

[63] Continuation of Ser. No. 617,070, Sep. 26, 1975, abandoned.

[30] Foreign Application Priority Data

Sep. 29, 1974 [DE] Fed. Rep. of Germany ..... 2446308

[51] Int. Cl.[2] ..... B21C 23/08; B21C 25/04; B21C 3/16

[52] U.S. Cl. ..... 72/269; 72/261; 72/264; 72/467

[58] Field of Search ..... 72/264, 268, 269, 261, 72/467, 468; 425/467

[56] References Cited

U.S. PATENT DOCUMENTS

| | | | |
|---|---|---|---|
| 2,266,189 | 12/1941 | Ganoe | 72/269 |
| 2,698,684 | 1/1955 | Guiney | 72/269 |
| 3,240,047 | 3/1966 | Long et al. | 72/269 |
| 3,380,129 | 4/1968 | Magruder | 425/467 X |
| 3,527,079 | 9/1970 | Braeuninger | 72/269 |
| 3,792,951 | 2/1974 | Meyers | 425/467 X |
| 3,858,426 | 1/1975 | Kuske | 72/269 |

FOREIGN PATENT DOCUMENTS

| | | | |
|---|---|---|---|
| 448529 | 5/1948 | Canada | 72/269 |
| 898883 | 12/1953 | Fed. Rep. of Germany | 72/269 |
| 931346 | 8/1955 | Fed. Rep. of Germany . | |
| 582599 | 9/1958 | Italy | 72/269 |
| 257417 | 4/1970 | U.S.S.R. | 72/269 |

OTHER PUBLICATIONS

*Nickel Topics:* published by International Nickel, vol. 22, No. 1; pp. 6 and 7 (1969) "For Unusual Strength and Toughness . . . Maraging Steel."

*Primary Examiner*—C. W. Lanham
*Assistant Examiner*—D. M. Gurley
*Attorney, Agent, or Firm*—Bachman and LaPointe

[57] ABSTRACT

The invention concerns a device for the extrusion of hollow or semi-hollow sections which are made in particular of a light metal. The device has at least one mandrel head on a mandrel support projecting into a die opening, the mandrel head being a special insert-type mandrel which is held in place on the mandrel support by a connecting device.

12 Claims, 8 Drawing Figures

Figure 4:
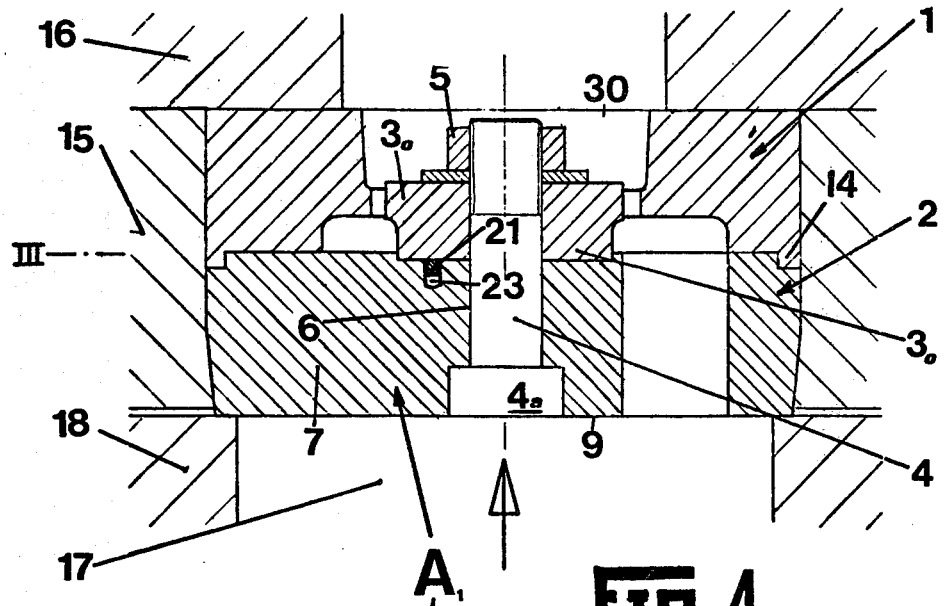

Fig. 1
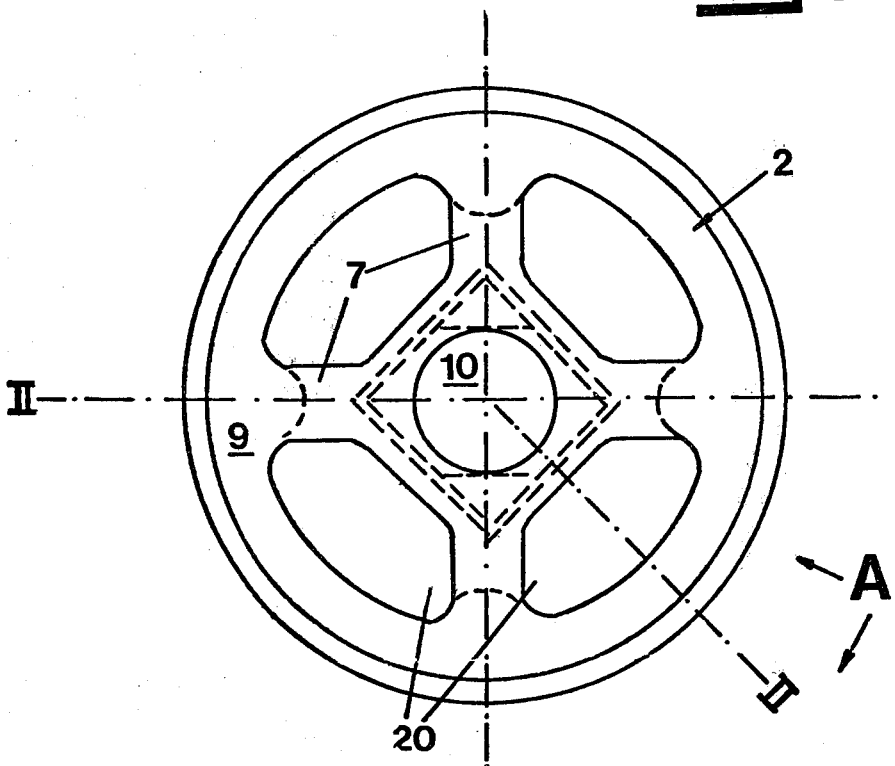
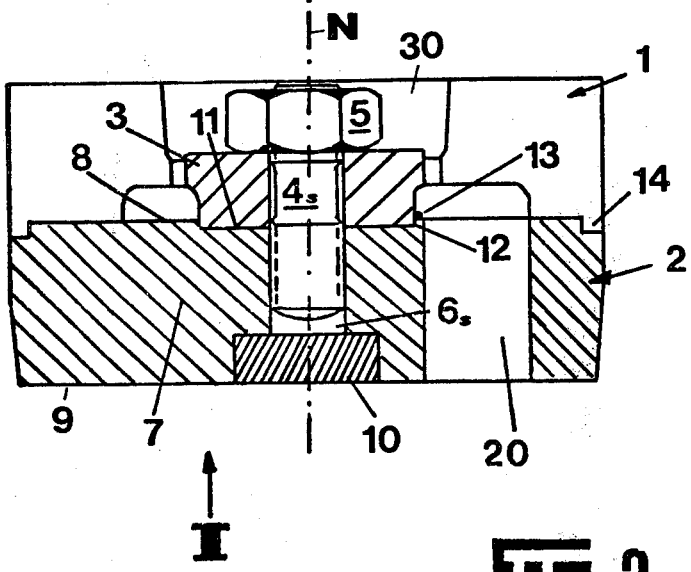
Fig. 2

DEVICE FOR EXTRUDING HOLLOW AND SEMI-HOLLOW SECTIONS

This is a continuation of application Ser. No. 617,070, filed Sept. 26, 1975 now abandoned.

The invention concerns a device for the extrusion of hollow and semi-hollow sections in particular such sections made of light metal, in which device there is at least one mandrel head on a mandrel support and projecting into the opening in the die of an extrusion tool.

Such a device is disclosed for example in the German Pat. No. DT-GM 74 12 358 in which a mandrel head on a mandrel neck is formed out of a mandrel plate, the mandrel head terminating in an opening delimited by a die bearing thus forming with that hole the outline of the section to be produced. Such extrusion tools with one piece mandrel neck and mandrel head set on bridging shoulders have the disadvantage that, even if high quality materials are employed for their manufacture, they fail due to fracture after only a short time in use since there is too marked a notch effect between mandrel neck and shoulder(s). These fractures occur in the main axis of the extrusion tools with large mandrel surfaces and in tools of the kind employed for the extrusion of diffcult-to-extrude light metal alloys.

One known possibility for reducing the notch effect is to provide a suitable curvature between the mandrel neck and the shoulder; however because this requires three demensional machining at the transition between mandrel neck and shoulder this is a very limited and expensive solution to the problem.

In order to get round this difficulty associated with the above extrusion tools the inventor had the idea to distribute the stresses which arise in connection with normal shapes of hollow and semi-hollow sections and to reduce the concentration of stresses at the base of the notch at the junction of the mandrel to the mandrel support by taking up the tensile forces on the mandrel and the surface loading of the mandrel support, and the resultant bending stresses, by the mandrel support itself.

This is achieved by means of specially designed insert mandrels which are held by a connecting piece on the mandrel support which at least in part lies below the die hole; the so-designed extrusion tool differs therefore from the normal kind in that the mandrel support or mandrel plate—consisting of bridging shoulders, mandrel neck and mandrel head—is no longer made as one part but instead out of a supporting part with shoulders and a mandrel which is fitted on to this supporting part; whereby the high notch stresses found in the one piece version do not arise.

A screw type of connection has been found to be a particularly favorable means of connecting the parts, making use of a screw of high strength material by which means the mandrel is held tight onto the plate-like mandrel support. In accordance with another feature of the invention, the screw passes through the mandrel plate (which may be separable) into the region of the hole which runs parallel to the principle axis of the tool or the direction of extrusion. This hole is made to pass completely through in order to prevent notch stresses arising and is usefully sealed off from the stream of metal being extruded, by means of an additional cover plate, to prevent the extruded material from penetrating that hole.

The screw can then be in the form of a bolt, through which only the tensile forces acting on the mandrel are to be taken up.

In order to ensure that the material being extruded does not penetrate the transverse joint between the mandrel and the mandrel plate, a weld which behaves elastically can be provided at the seat of the mandrel, although the danger of such penetration occurring seems unlikely since the transverse gap is on the far side of the mandrel from the material being extruded.

Rotation of the mandrel mounted on the mandrel plate in the case of a single central screw connection is prevented by means of a recess in the mandrel plate in which the mandrel fits; additionally, projections from the mandrel can engage in corresponding recesses in the mandrel plate—in normal extrusion practice however this additional measure has been found to be unnecessary.

Further advantages, features and details of the invention of preferred embodiments of the invention and with the aid of drawings viz., FIG. 1: An end view of the mandrel plate of an extrusion tool, viewed in the direction of extrusion as indicated by an arrow I in FIG. 2.

FIG. 2: A section through the mandrel plate along the line II—II in FIG. 1, with the die plate in position.

Figure 3:
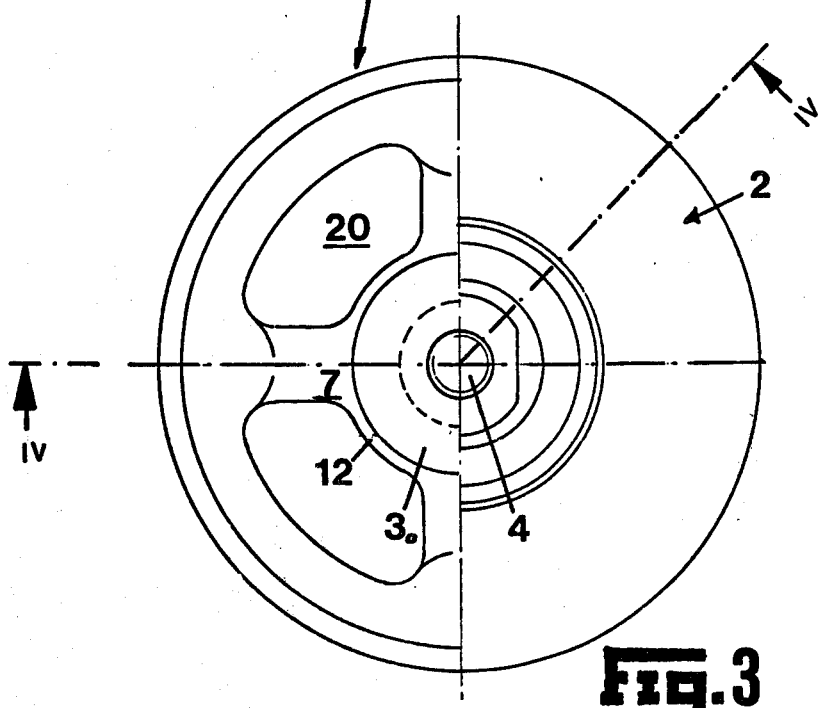

FIG. 3: An end view comprising views in the direction of extrusion and in the opposite direction, of another extrusion tool.

FIG. 4: A section along the line IV—IV in FIG. 3.

Figure 5:
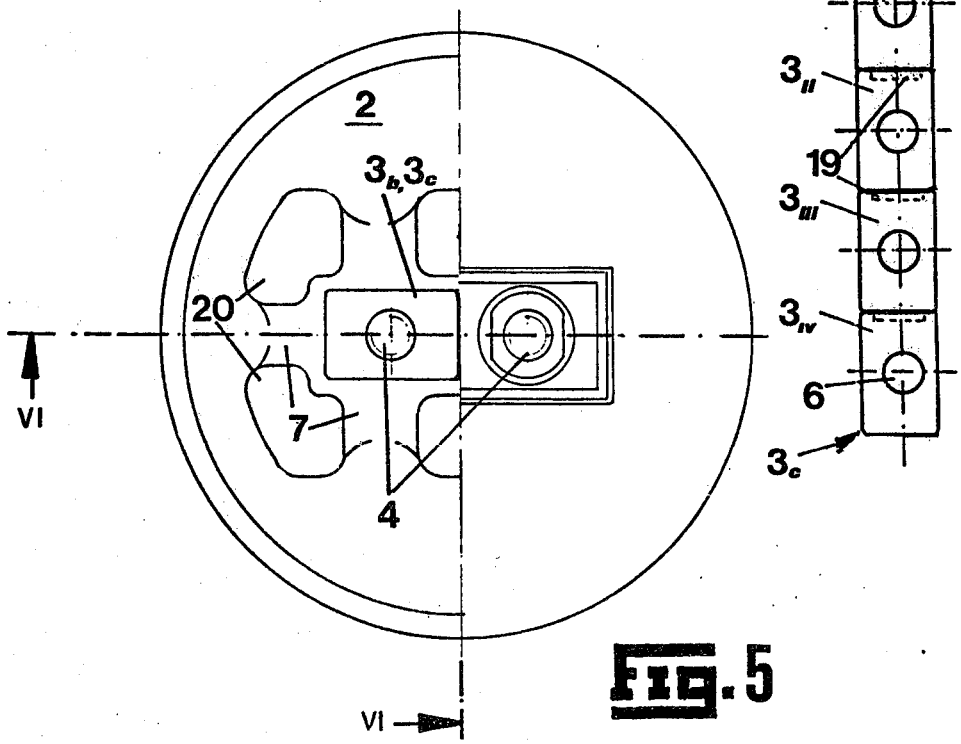

FIG. 5: An end view comprising views in the direction of extrusion and the opposite direction, of another extrusion tool with an mandrel held by two screws.

Figure 6:
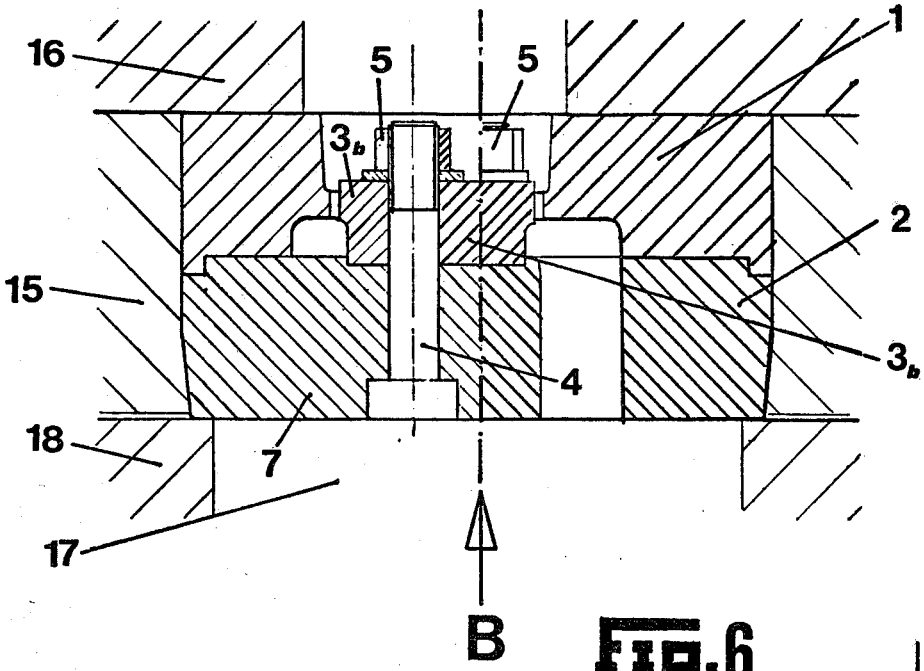

FIG. 6: A section along VI—VI in FIG. 5.

Figure 7:
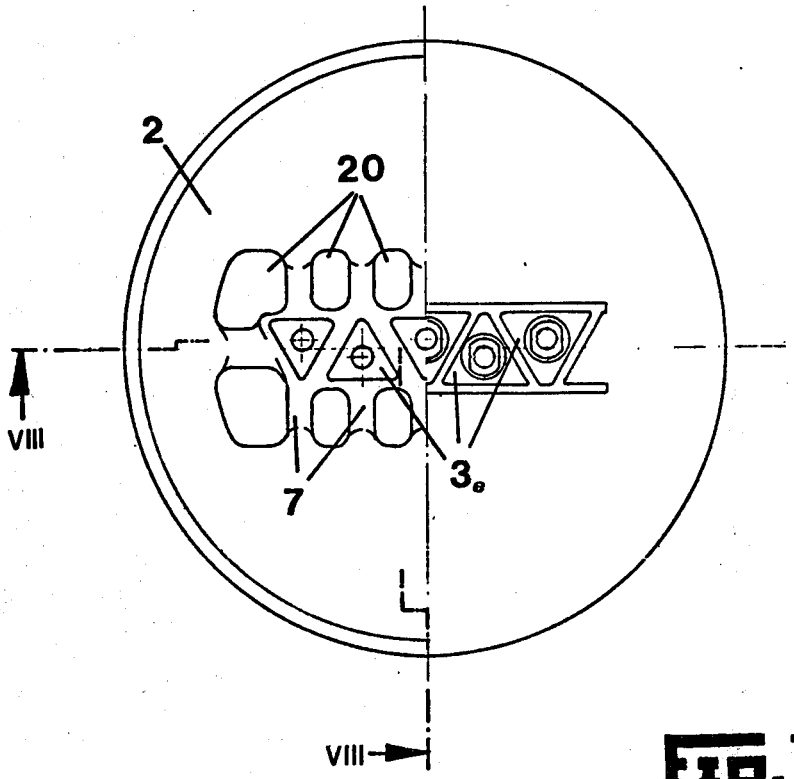

FIG. 7: The view corresponding with that in FIG. 3 or FIG. 5 of an extrusion tool with several mandrel parts.

Figure 8:
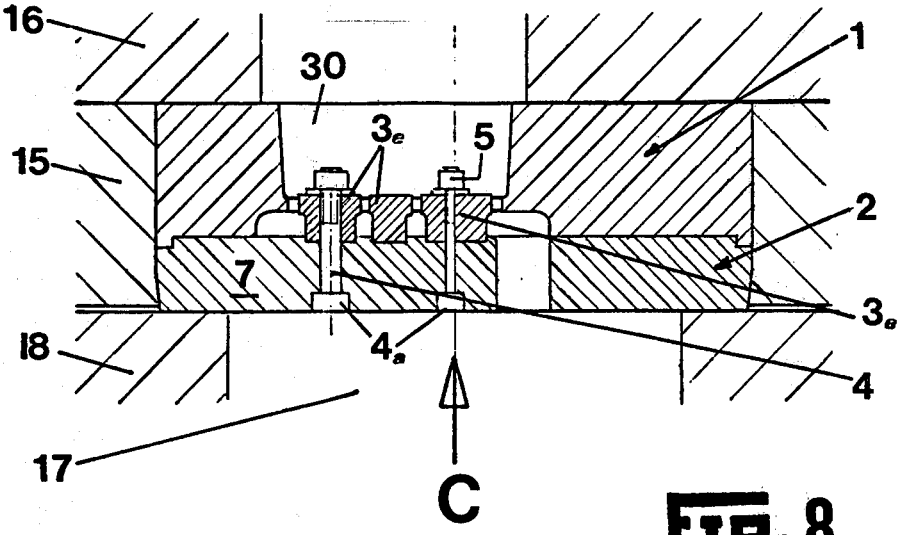

FIG. 8: A section along the line VIII—VIII in FIG. 7.

A rectangular block-like mandrel 3 is releasably secured in a central position of a cylindrical tool A consisting of a die plate 1 and a mandrel plate 2 for the extrusion of single chamber hollow sections, by means of a bolt 4s of vacuum-melted high strength martensitic 18 Ni-Cr-Mo steel, and a nut 5, the mandrel 3 projecting into a central hole 30 in the die plate 1. The bolt 4s is positioned in a threaded hole 6s which passes through the shoulder 7 between holes 20 in the mandrel plate 2; the hole 6s is provided to prevent additional notch stresses and is closed by a cover plate 10 which prevents the material being extruded from entering the hole 6s.

The mandrel 3 is separated from the surface of the shoulders 7 at a transverse junction 11, where the mandrel 3 is engaged in a cassette-like recess 12 and is therefore prevented from rotating.

In order to prevent the material being extruded from entering the joint 11, a weld 13 which behaves elastically can be provided around the seat of the mandrel 3.

In the case of an extrusion tool A, as shown in FIGS. 3 and 4, the die plate 1 and the mandrel plate 2 engage in one another due to a round shoulder 14; and are surrounded by a die-ring 15. By means of this die-ring 15 the extrusion tool $A_1$, the round mandrel 30 of which is secured on the mandrel plate 2 by a screw connection consisting of a bolt 4 and a nut 5 is introduced in the assembled condition into an extrusion press which is not shown here. The tool is braced by a bolster 16. During extrusion, a container 18 surrounding the extrusion billet or ingot 17 lies next to the bolster 16 on the mandrel plate 2 or the die ring 15. In this example the head 4a of the bolt 4 protects the hole 6 from penetration by the metal being extruded. A tapered pin projecting out from the under face of the mandrel 30 engages in a blind hole 23 in the mandrel plate 2 and provides an additional measure of preventing rotation.

In the case on an extrusion tool B two bolts 4, on opposite sides of the principle axis of the tool and passing through the holes 6, hold an extended block-shaped mandrel 3b in a central position between six holes 20; the tool B can, but not shown here, be fitted with more than two bolts 4 for the block shaped mandrel 3b.

Subdivision of such a mandrel (3c) into several mandrel parts 3 I to 3 IV, each held by a bolt 4—as shown in FIG. 5 and as reproduced at the side of the main figure—has been found to be of particular value for reasons relating to strength as already explained; this way the mandrel parts 3 I to 3 IV can be tightly held together in place by a groove/spring connection 19.

Also the mandrels 3e in the form of equilateral triangles, in the extrusion tool C, have bolts 4a through each part mandrel and by means of these are held tight on the mandrel plate 2.

What we claim is:

1. In an extrusion device for use in an extrusion tool including a die plate having two sides and defining a die passageway and opening for the extrusion of hollow sections of light metal, said device being of the type having at least one mandrel disposed on a mandrel support and projecting into the opening of the die, the improvement comprising:

said mandrel support having a surface disposed on one side of said die plate, said surface including a first part in line with said one side of said die plate and at least one second part recessed from said first part;

said at least one mandrel having a first side disposed in said recess of said at least one second part and a second side projecting into said die passageway, said at least one mandrel being at least partly in line with said die opening;

at least one screw type connection means comprising a head portion and a stem portion operable for detachably engaging said mandrel in said recess of said at least one second part whereby the stresses at the junction of the mandrel and mandrel support exerted by the extruding metal are reduced and distributed; and wherein said mandrel and said at least one second part of said mandrel support surface each have a hole defined therein and extending therethrough wherein said stem portion is received within said hole defined in said mandrel support and said head portion abuts the said second side of said at least one mandrel.

2. The device as claimed in claim 1 wherein said mandrel support comprises an outer ring member and an inner junction member, said outer ring member and said inner junction member being connected by a plurality of shoulder members, said inner junction member being provided in part with said at least one second part of said mandrel support surface.

3. The device as claimed in claim 2 wherein said mandrel support includes a cover plate for engaging and thereby substantially sealing said hole in said at least one second part of said mandrel support surface on the side not supporting said mandrel.

4. The device as claimed in claim 3 wherein said hole in said mandrel support is threaded and said stem portion comprises a bolt operable for passing through the hole in said mandrel and engaging the threaded hole in said mandrel support.

5. The device as claimed in claim 2 wherein said at least one means comprises a screw composed of a hardenable martensitic nickel alloy.

6. The device as claimed in claim 2 wherein said inner junction member is provided with a plurality of said second surface parts and at least one mandrel being disposed on each of said second parts, each of said mandrels including means operable for detachably engaging said mandrel to said mandrel support.

7. The device as claimed in claim 2 further comprising a sealing weld on said first part of said mandrel support surface in proximate contact with said mandrel so as to insure that the metal being extruded does not penetrate the joint between said mandrel and said second part of said mandrel support surface.

8. The device as claimed in claim 2 wherein said second part of said mandrel support surface has a recess defined therein, said mandrel includes a pin extending therefrom for engaging said recess.

9. The device as claimed in claim 1 wherein said hole extends in a direction substantially parallel to the direction of extrusion of metal through said device.

10. The device as claimed in claim 1 wherein said mandrel support includes a cover plate for engaging and thereby substantially sealing said hole in said at least one second part of said mandrel support surface on the side not supporting said mandrel.

11. The device as claimed in claim 1 further comprising a sealing weld on said first part of said mandrel support surface in proximate contact with said mandrel so as to insure that the metal being extruded does not penetrate the joint between said mandrel and said second part of said mandrel support surface.

12. The device as claimed in claim 1 wherein said mandrel support comprises an outer ring member and an inner junction member, said inner junction member being provided in part with said at least one second part of said mandrel support surface.

* * * * *